US007708371B2

(12) United States Patent
Yamanobe

(10) Patent No.: US 7,708,371 B2
(45) Date of Patent: May 4, 2010

(54) IMAGE FORMING APPARATUS

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 718 days.

(21) Appl. No.: 11/519,924

(22) Filed: Sep. 13, 2006

(65) Prior Publication Data

US 2007/0058022 A1 Mar. 15, 2007

(30) Foreign Application Priority Data

Sep. 14, 2005 (JP) ..... 2005-267019

(51) Int. Cl.
*B41J 29/38* (2006.01)
*B41J 2/205* (2006.01)
*B41J 29/393* (2006.01)

(52) U.S. Cl. ..... 347/19; 347/14; 347/15

(58) Field of Classification Search ..... 347/14, 347/15, 19, 103
See application file for complete search history.

(56) References Cited

U.S. PATENT DOCUMENTS 6,911,993 B2 * 6/2005 Nishikawa et al. ..... 347/116
2001/0022607 A1 9/2001 Takahashi et al.
2005/0152706 A1 * 7/2005 Koie et al. ..... 399/15
2006/0066657 A1 * 3/2006 Folkins et al. ..... 347/19

FOREIGN PATENT DOCUMENTS

JP 2001-10224 A 1/2001
JP 2001-347747 A 12/2001

* cited by examiner

*Primary Examiner*—Matthew Luu
*Assistant Examiner*—Kendrick X Liu
(74) *Attorney, Agent, or Firm*—Birch, Stewart, Kolasch & Birch, LLP.

(57) ABSTRACT

The image forming apparatus comprises: an image forming device which includes an intermediate transfer body having a transfer surface on which an image is formed according to a first image data, the image forming device performing a transfer of the image onto a recording medium from the transfer surface; a transfer state determination device which determines a state of the transfer surface after the transfer of the image onto the recording medium has been performed; and an image correction device which corrects a second image data corresponding to an image formed on the transfer surface, according to the state of the transfer surface determined by the transfer state determination device.

9 Claims, 16 Drawing Sheets

START

CLEAR Tmp
S200
j ← J0
S202
i ← 0
S204
S210
DROPLET EJECTED AT (i, j)?
N
Y
S222
HAS (i, j) BEEN REGISTERED IN C?
Y
N
S223
IS THERE RESIDUAL TRANSFER IMAGE AT (i, j)?
N
S224
DELETE (i, j) FROM C
S243
IS THERE RESIDUAL TRANSFER IMAGE AT (i, j)?
N
Y
S244
HAS (i, j) BEEN REGISTERED IN Tmp?
Y
S246
DELETE (i, j) FROM Tmp AND ADD (i, j) TO C
N
(ADD (i, j) TO Tmp
S248
i ← i + 1
S262
S264
i = IM?
N
Y
j ← j + 1
S266

FIG.14

| | TRANSFER STATE DETERMINATION UNIT | IMAGE STATE DETERMINATION UNIT |
|---|---|---|
| PATTERN 1 | OK | OK |
| PATTERN 2 | NG | OK |
| PATTERN 3 | OK | NG |
| PATTERN 4 | NG | NG |

(OK:NO ERROR NG:ERROR)

IMAGE FORMING APPARATUS

BACKGROUND OF THE INVENTION

1. Field of the Invention

The present invention relates to an image forming apparatus, and more particularly, to an image forming apparatus which forms an image on an intermediate transfer body by depositing liquid on the intermediate transfer body, and then transfers the image onto a recording medium such as paper.

2. Description of the Related Art

An image forming apparatus is known in which an image is formed on an intermediate transfer body by depositing ink onto the intermediate transfer body, and the image on the intermediate transfer body is then transferred onto a recording medium such as paper.

Japanese Patent Application Publication No. 2001-347747 discloses technology in which, firstly, a material which increases the viscosity of liquid droplets by making contact with the liquid droplets is deposited on the intermediate transfer body, whereupon liquid droplets are placed in contact with the material in accordance with an image signal and an image is formed by means of the liquid droplets which are raised in viscosity, and this image is then transferred onto a recording medium.

Japanese Patent Application Publication No. 2001-10224 discloses technology in which a member for removal material, such as coloring material, remaining on the intermediate transfer body is provided.

However, there is a possibility that a portion of the coloring material remains on the intermediate transfer body, and the transfer to the recording medium, such as paper, from the intermediate transfer body, is not complete.

For example, if the transfer surface has become degraded due to the formation of scratches, or the like, on the surface of the intermediate transfer body (transfer surface), then in general, there arises a semi-permanent incapacity to transfer coloring material to the recording medium from the degraded region. If transfer to the recording medium is insufficient due to deterioration of the transfer surface in this way, then density non-uniformities occur (more specifically, regions of weak density occur) in the printed object, and it can lead to major quality inconvenience.

The technology described in Japanese Patent Application Publication No. 2001-347747 increases the viscosity of liquid droplets and transfers them to a recording medium; however, it cannot deal with the issue of degradation of the transfer surface, and if transfer errors arise due to degradation of the transfer surface, then print quality can decline.

The technology described in Japanese Patent Application Publication No. 2001-10224 performs cleaning of the transfer surface; however, if the transfer surface is degraded permanently due to the formation of scratches, or the like, then transfer errors can arise and print quality can decline.

SUMMARY OF THE INVENTION

The present invention is contrived in view of the foregoing circumstances, an object thereof being to provide an image forming apparatus which is able to prevent deterioration of image quality in an image formed on a recording medium, such as paper, even if transfer errors arise.

In order to attain the aforementioned object, the present invention is directed to an image forming apparatus comprising: an image forming device which includes an intermediate transfer body having a transfer surface on which an image is formed according to a first image data, the image forming device performing a transfer of the image onto a recording medium from the transfer surface; a transfer state determination device which determines a state of the transfer surface after the transfer of the image onto the recording medium has been performed; and an image correction device which corrects a second image data corresponding to an image formed on the transfer surface, according to the state of the transfer surface determined by the transfer state determination device.

The image forming apparatus may use any recording method, such as an inkjet method, an electrophotographic method, and the like, provided that an image is first formed on an intermediate transfer body and then subsequently transferred onto a recording medium.

According to this aspect of the present invention, the state of the transfer surface after the transfer from the intermediate transfer body is determined by means of the transfer state determination device, and the image data is corrected by the image correction device on the basis of the determined state of the transfer surface. Accordingly, it is possible to prevent deterioration in the quality of the image formed on the recording medium.

The first image data and the second image data may be the same image data or be different image data.

Preferably, the image forming apparatus further comprises an adhering matter removal device which is provided posterior to the transfer state determination device in terms of a direction of movement of the transfer surface of the intermediate transfer body and removes adhering matter remaining on the transfer surface.

According to this aspect of the present invention, the next image is formed on the transfer surface after remaining adhering matter has been removed from the transfer surface.

Preferably, the transfer state determination device obtains determination results by determining a plurality of the states of the transfer surface which are respectively shown after a plurality of the transfers; and the image correction device corrects the second image data according to the determination results.

According to this aspect of the present invention, the image data is corrected on the basis of the plurality of transfer results. Therefore, the image data can be corrected while a temporary transfer error is distinguished from a permanent transfer error.

Preferably, the transfer state determination device determines the state of the transfer surface only in a region on the transfer surface in which the image has been formed, according to the first image data.

According to this aspect of the present invention, the determination accuracy of the transfer state is improved.

Preferably, the image forming apparatus further comprises an image state determination device which determines a state of a transferred image on the recording medium which is obtained by the transfer of the image onto the recording medium, wherein the image correction device corrects the second image data, according to the state of the transfer surface determined by the transfer state determination device and the state of the transferred image on the recording medium determined by the image state determination device.

According to this aspect of the present invention, it is possible to distinguish between a transfer error and an ejection error.

According to the present invention, it is possible to reduce the deterioration of the quality of an image formed on a recording medium, such as paper, even if a transfer error occurs.

BRIEF DESCRIPTION OF THE DRAWINGS

The nature of this invention, as well as other objects and benefits thereof, will be explained in the following with reference to the accompanying drawings, wherein:

FIG. 14 is an illustrative diagram showing a combination of a determination result by the transfer state determination unit and a determination result by the image state determination unit;

DETAILED DESCRIPTION OF THE PREFERRED EMBODIMENTS

Figure 1:
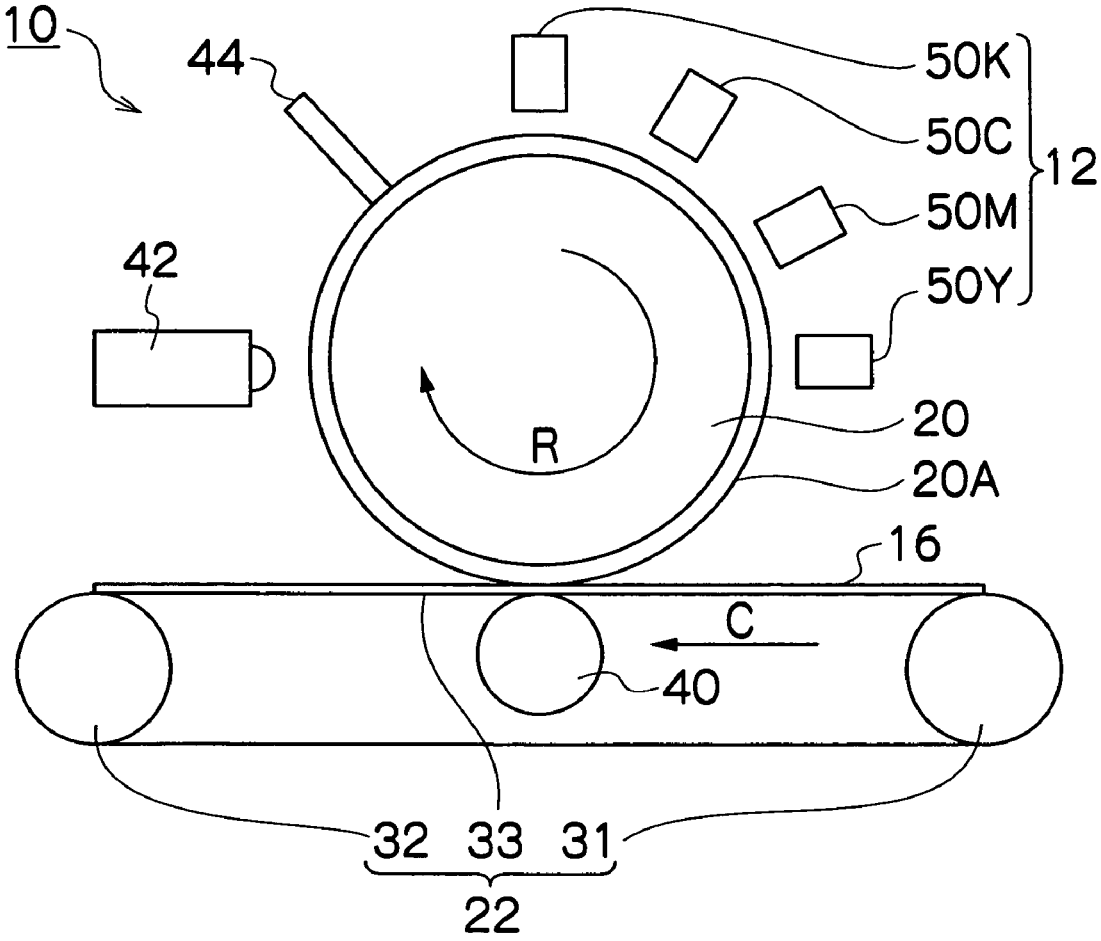
FIG. 1 is a general schematic drawing showing an approximate view of the functional composition of an image forming apparatus according to a first embodiment.

FIG. 1 is a general schematic drawing showing the general functional composition of an image forming apparatus 10 relating to a first embodiment of the present invention.

In FIG. 1, the image forming apparatus 10 according to the present embodiment comprises: a liquid droplet ejection unit 12 (image forming device) which ejects liquid droplets (ink droplets) containing coloring material on the basis of image data input from a source external to the image forming apparatus 10; a transfer drum 20 (intermediate transfer body) having a transfer surface 20A on which the liquid droplets ejected from the liquid droplet ejection unit 12 are deposited; a conveyance unit 22 which conveys recording paper 16 onto which the image (transfer image) formed on the transfer surface 20A of the transfer drum 20 is transferred; a pressing roller 40 which presses the recording paper 16 against the transfer surface 20A of the transfer drum 20; a transfer state determination unit 42 which determines the state of the transfer surface 20A of the transfer drum 20; and a cleaning unit 44 (adhering matter removal device) which cleans the transfer surface 20A of the transfer drum 20.

The arrow R in the drawing indicates the direction of rotation of the transfer drum 20, and the liquid droplet ejection unit 12, pressing roller 40, transfer state determination unit 42, and cleaning unit 44 are disposed in this order, in the direction of rotation of the drum. In other words, each point on the transfer surface 20A of the transfer drum 20 passes sequentially through positions opposing the liquid droplet ejection unit 12, the pressing roller 40, the transfer state determination unit 42, and the cleaning unit 44, and then returns again to a position opposing the liquid droplet ejection unit 12.

In the present embodiment, the liquid droplet ejection unit 12 comprises a plurality of liquid droplet ejection heads 50Y, 50M, 50C and 50K, which respectively eject ink droplets of the colors of yellow (Y), magenta (M), cyan (C) and black (K). Each point on the transfer surface 20A of the transfer drum 20 moves successively to oppose the ink ejection surfaces of the Y ink liquid droplet ejection head 50Y, the M ink liquid droplet ejection head 50M, the C ink liquid droplet ejection head 50C and the K ink liquid droplet ejection head 50K. While the transfer drum 20 is rotated in the direction indicated by the arrow R in FIG. 1, ink droplets of the respective colors are ejected on the basis of the image data, toward the transfer surface 20A of the transfer drum 20, from the respective liquid droplet ejection heads 50Y, 50M, 50C and 50K, thereby forming a transfer image on the transfer surface 20A of the transfer drum 20.

The liquid droplet ejection heads 50 (50Y, 50M, 50C, 50K) are line heads having a length corresponding to the width of the transfer surface 20A of the transfer drum 20 (in other words, a length corresponding to the maximum formable width of the transfer image). The lengthwise direction of the liquid droplet ejection head 50 is a direction parallel to the rotational axis of the transfer drum 20, and it is situated in a direction perpendicular to the direction of movement of the transfer surface 20A. A more detailed description is given below, but a plurality of nozzles are disposed on the ink ejection surface (nozzle surface) of the liquid droplet ejection head 50.

In the example shown in FIG. 1, although a configuration with the four standard colors, Y M C and K, is described in the example shown in FIG. 1, the combinations of the ink colors and the number of colors are not limited to the four colors of Y, M, C and K, and light and/or dark inks can be added as required. For example, a configuration is also possible in which liquid droplet ejection heads for ejecting light-colored inks, such as light cyan and light magenta, are added. Furthermore, for example, a configuration is also possible in which liquid droplet ejection heads for ejecting inks such as red or green are added.

Although omitted from the drawings, the image forming apparatus 10 also comprises ink tanks which stores inks of respective colors corresponding to the liquid droplet ejection heads 50Y, 50M, 50C and 50K, in such a manner that ink is supplied to the liquid droplet ejection heads 50Y, 50M, 50C and 50K via ink channels (not illustrated).

In the present embodiment, the conveyance unit 22 has a structure in which an endless belt 33 is wound around conveyance rollers 31 and 32. The belt 33 has a broader width dimension than the recording paper 16. The belt 33 is driven in the counter-clockwise direction in FIG. 1 by means of the motive force of a motor (not illustrated) being transmitted to at least one of the conveyance rollers 31 and 32, which the belt 33 is set around, and the recording paper 16 held on the belt 33 is conveyed in the direction indicated by arrow C in FIG. 1.

When the front end of the recording paper 16 on the belt 33 is conveyed to the contact point between the belt 33 and the transfer surface 20A of the transfer drum 20, the recording paper 16 is moved further in the direction of arrow C while being pressed in contact with the transfer surface 20A of the transfer drum 20 due to the tension of the belt 33 and the pressing force of the pressing roller 40. Accordingly, the image on the transfer surface 20A of the transfer drum 20 is transferred to the recording paper 16.

In this way, the image forming apparatus 10 according to the present embodiment temporarily forms a transfer image on the transfer surface 20A of the transfer drum 20, and then transfers this transfer image onto recording paper 16. Consequently, it can be used with many different types of recording paper 16, thus increasing the freedom of choice of the recording paper 16.

Once the transfer image formed on the transfer surface 20A of the transfer drum 20 has been transferred to the recording paper 16, the state of the transfer surface 20A of the transfer drum 20 (the transfer state) is determined by the transfer state determination unit 42. In particular, the locations where residual parts of the transfer image have been left are determined.

The transfer state determination unit 42 is constituted by a line sensor which is capable of continuously capturing images of the transfer surface 20A of the transfer drum 20. This line sensor comprises a plurality of photosensors (imaging elements) arranged through a length corresponding to the full width of the transfer surface 20A of the transfer drum 20 (in other words, the maximum formable width of the transfer image). More specifically, the line sensor is disposed in a direction parallel to the rotational axis of the transfer drum 20, which is a direction perpendicular to the direction of movement of the transfer surface 20A. One specific example of such a line sensor is a CCD (Charge Coupled Device).

Desirably, the transfer surface 20A of the transfer drum 20 is formed with a substantially white color, since this makes it easier to perceive the contrast between the coloring material in the liquid droplets adhering to the transfer surface 20A and the transfer surface 20A itself.

After the transfer state of the transfer surface 20A of the transfer drum 20 is determined by means of the transfer state determination unit 42, unwanted adhering material such as residual liquid droplets or dust on the transfer surface 20A of the transfer drum 20 are removed by the cleaning unit 44, which is disposed posterior to the transfer state determination unit 42 in terms of the direction of movement of the transfer surface 20A.

Figure 2:
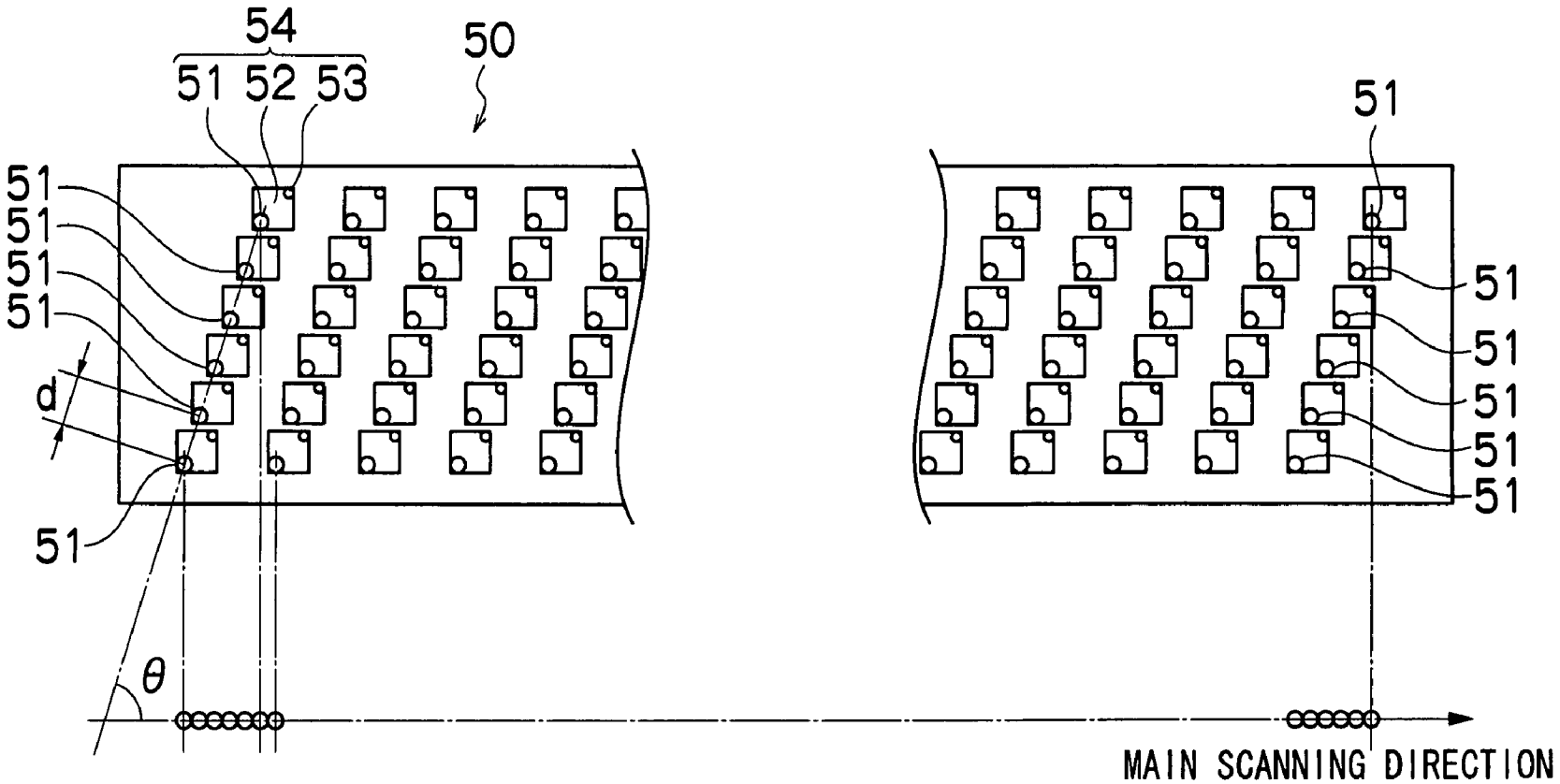
FIG. 2 is a plan view perspective diagram showing an approximate view of one example of the general structure of a liquid droplet ejection head.

FIG. 2 is a plan view perspective diagram showing an approximate view of one example of the general structure of a liquid droplet ejection head 50.

In FIG. 2, the liquid droplet ejection head 50 comprises a plurality of pressure chamber units 54 arranged in a two-dimensional configuration, each pressure chamber unit 54 comprising a nozzle 51 (ejection port) which ejects ink toward the recording paper 16, a pressure chamber 52, connected to the nozzle 51, and an ink supply port 53 forming an opening section by which ink is supplied to the pressure chamber 52. In FIG. 2, in order to simplify the drawing, a portion of the pressure chamber units 54 is omitted from the drawing.

The plurality of nozzles 51 are arranged in the form of a two-dimensional matrix, following two directions: a main scanning direction, which is the lengthwise direction of the liquid droplet ejection head 50, and an oblique direction forming a prescribed angle of $\theta$ with respect to the main scanning direction. Here, the main scanning direction is a direction perpendicular to the direction of movement of the transfer surface 20A of the transfer drum 20. More specifically, by arranging a plurality of nozzles 51 at a uniform pitch of d in an oblique direction forming a uniform angle of $\theta$ with respect to the main scanning direction, it is possible to treat the nozzles 51 as being equivalent to an arrangement of nozzles at a prescribed pitch ($d \times \theta$) in a straight line in the main scanning direction. According to this nozzle arrangement, for example, it is possible to achieve a composition which is substantially equivalent to a high-density nozzle arrangement which reaches 2400 nozzles per inch in the main scanning direction, for example. In other words, a high density is achieved in the nozzle arrangement (projected nozzle arrangement) obtained by projecting the nozzles to an alignment in a straight line (main scanning line) following the main scanning direction. The nozzle arrangement following two directions as shown in FIG. 2 is called a two-dimensional matrix nozzle arrangement.

By means of the nozzle arrangement such as that shown in FIG. 2, a full line type of liquid droplet ejection head 50 is composed, having a row of nozzles covering a length corresponding to the full width of the transfer surface 20A and the full width of the recording paper 16 in the main scanning direction.

The plurality of pressure chambers 52 connected in a one-to-one correspondence with the plurality of nozzles 51 are arranged in a two-dimensional matrix configuration, similarly to the nozzles 51. Furthermore, although not shown in the drawings, a plurality of actuators corresponding one-to-one with the plurality of pressure chambers 52 are also provided. When an electrical signal (drive signal) is applied to these actuators in accordance with the image data relating to the image to be transferred onto the recording paper 16, then the actuators change the volume of the pressure chambers 52 in accordance with the drive signal, in such a manner that liquid droplets are ejected from the nozzles 51 toward the transfer surface 20A of the transfer drum 20.

Figure 3:
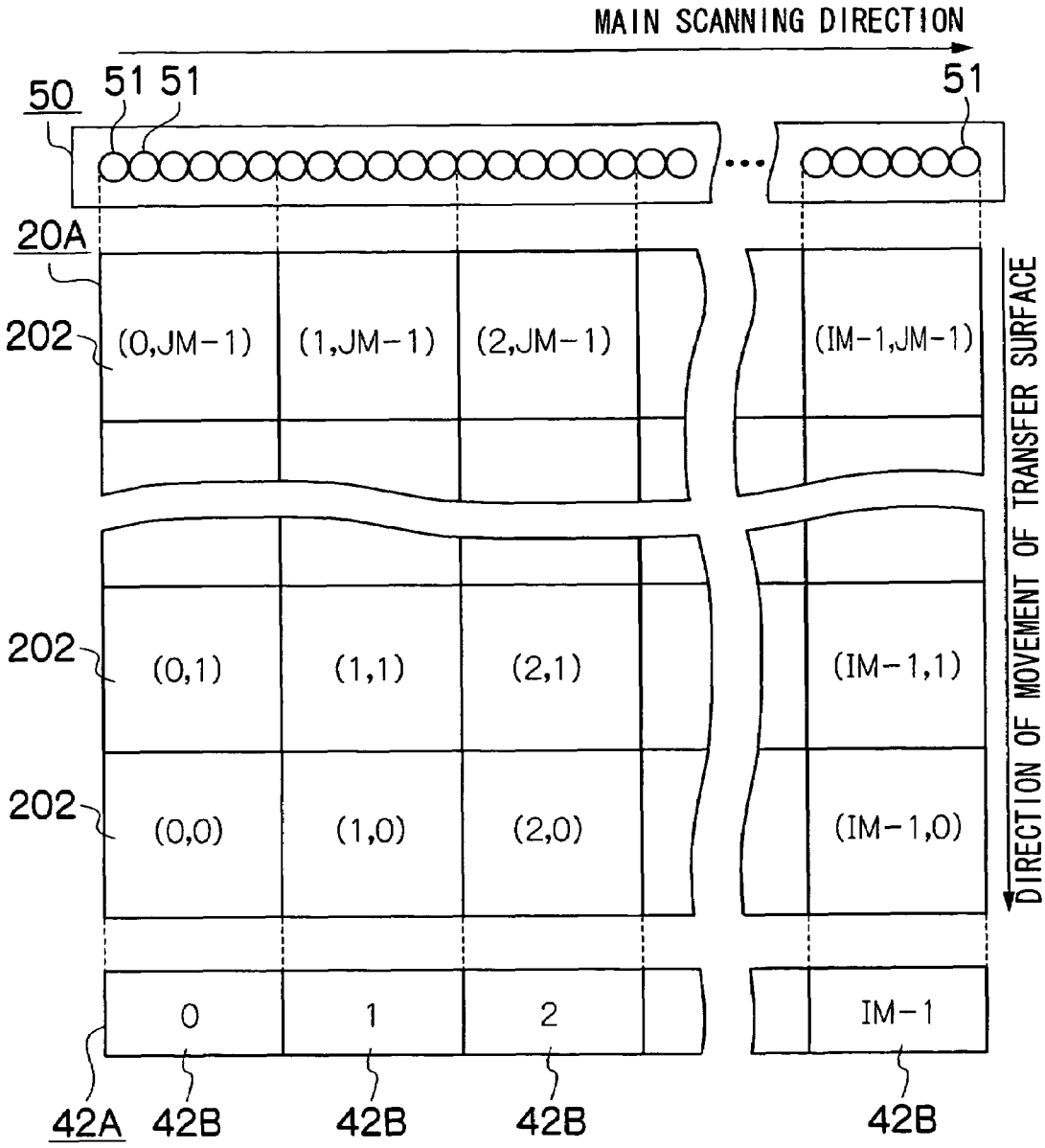
FIG. 3 is a schematic drawing showing the relation among nozzles of the liquid droplet ejection head, the transfer surface, and determination positions of the transfer state determination unit.

FIG. 3 is a schematic drawing showing one example of the positional correspondence among the projected nozzle arrangement of the liquid droplet ejection head 50, the transfer surface 20A of the transfer drum 20, and the line sensor 42A of the transfer state determination unit 42.

In the example shown in FIG. 3, the density of the photosensors 48B constituting the line sensor 42A (in other words, the imaging resolution of the transfer surface 20A) is lower than the density of the nozzles 51 in the projected nozzle arrangement (in other words, the resolution of the transfer image). Here, one photosensor 42B of the line sensor 42A corresponds to a plurality of nozzles 51 (for example, six nozzles 51) of the projected nozzle arrangement. In other words, a composition is adopted in which one block 202 comprising a plurality of pixels (for example, 6×6 pixels) on the transfer surface 20A is imaged by one photosensor 42B of the line sensor 42A.

It is desirable to adopt a composition of this kind in which the imaging resolution is lower than the resolution of the transfer image, since it makes it possible to reduce the load of transfer state determination processing, as well as to reduce the costs. However, it is also possible to adopt a composition in which the imaging resolution of the line sensor 42A is equal to the resolution of the transfer image.

Next, a representative example of residual transfer image occurring on the transfer surface 20A is explained below with reference to FIGS. 4A to 4D.

Figure 4A:
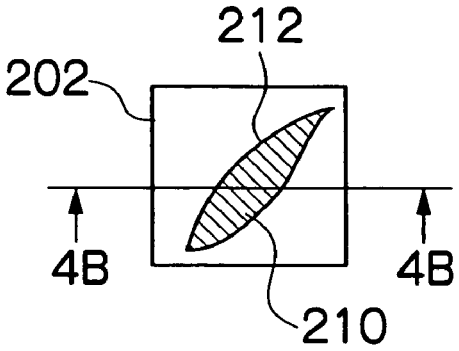
FIGS. 4A to 4D are schematic diagrams showing representative examples of residual transfer image.
Figure 4B:
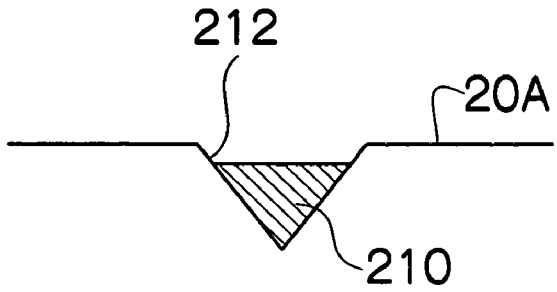

FIG. 4A shows a very small scratch 212 formed on the transfer surface 20A. Furthermore, FIG. 4B shows a cross-sectional diagram along line 4B-4B in FIG. 4A. As shown in FIGS. 4A and 4B, ink 210 remains inside the scratch 212 in the transfer surface 20A, after transfer.

Figure 4C:
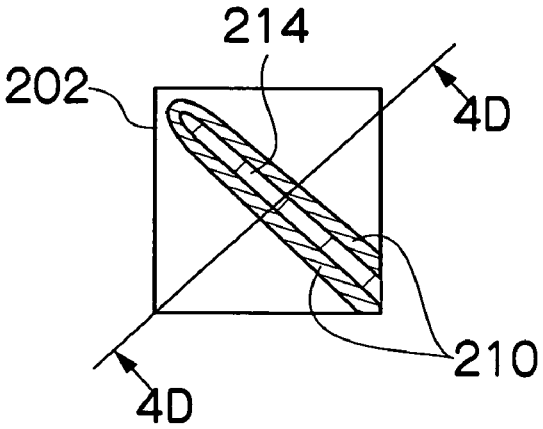
Figure 4D:
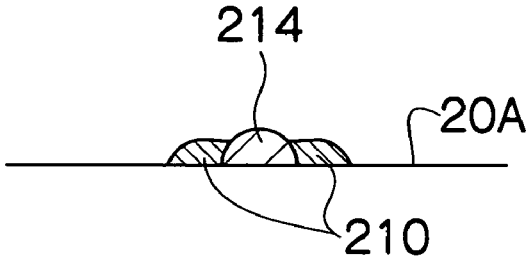

FIG. 4C shows a fiber-shaped piece of dust 214 adhering to the transfer surface 20A. Furthermore, FIG. 4D shows a cross-sectional diagram along line 4D-4D in FIG. 4C. As shown in FIGS. 4C and 4D, ink 210 remains about the periphery of the dust 214 adhering to the transfer surface 20A, after the transfer.

The transfer state determination unit 42 according to the present embodiment determines, in particular, ink 210 remaining inside a scratch 212 such as that shown in FIGS. 4A and 4B, and ink 210 remaining about the periphery of dust 214 such as that shown in FIGS. 4C and 4D.

Figure 5:
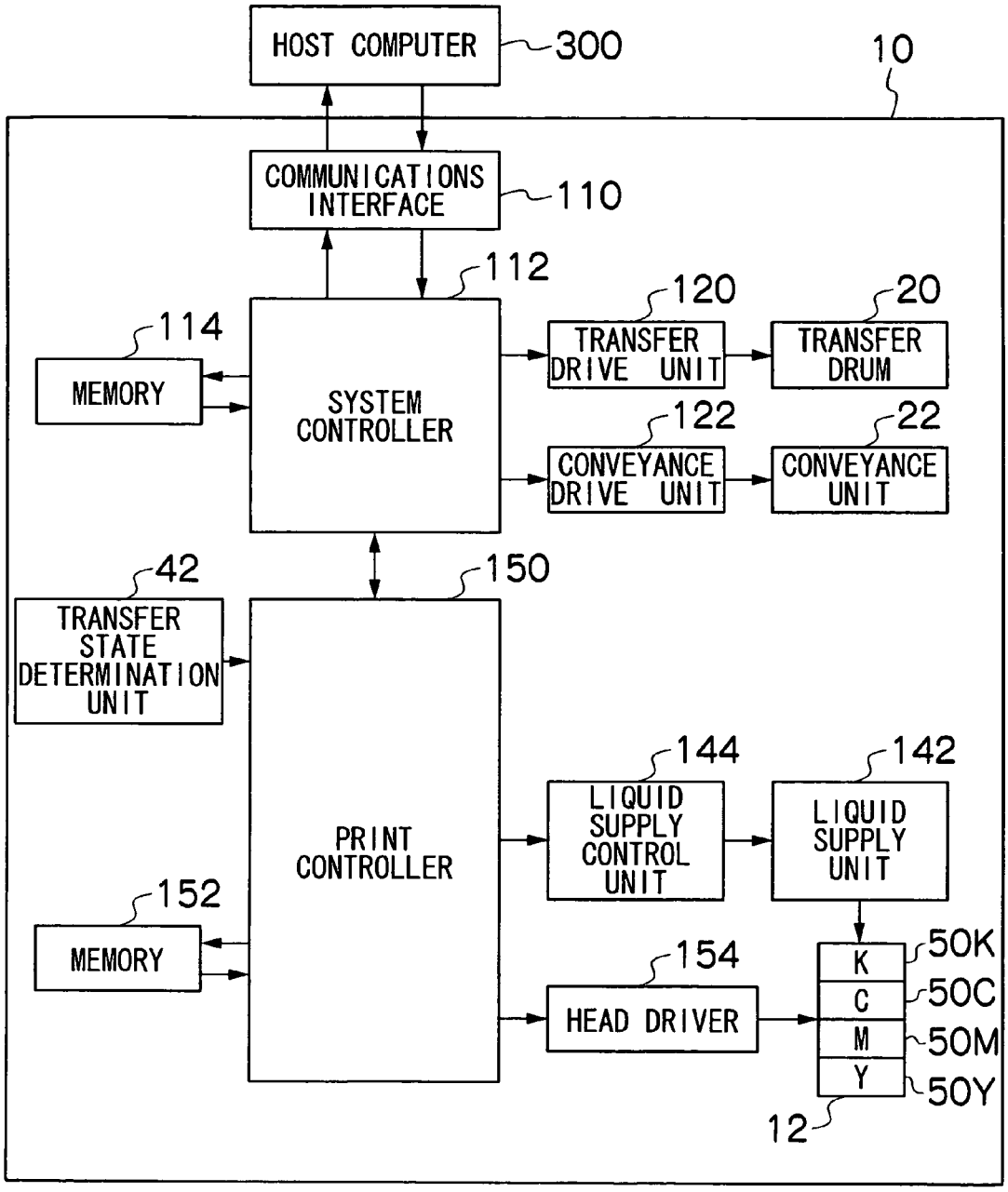
FIG. 5 is a block diagram showing an approximate view of the functional composition of the image forming apparatus according to the first embodiment.

FIG. 5 is a block diagram showing the approximate functional composition of the image forming apparatus 10 illustrated in FIG. 1.

In FIG. 5, the image forming apparatus 10 chiefly comprises: a liquid droplet ejection head 12 (image forming device), a transfer drum 20 (intermediate transfer body), a conveyance unit 22, a transfer state determination unit 42, a communications interface 110, a system controller 112, memories 114 and 152, a transfer drive unit 120, a conveyance drive unit 122, a liquid supply unit 142, a liquid supply control unit 144, a print controller 150 (image correction device), and a head driver 154.

The communications interface 110 constitutes an image data input device for receiving image data transmitted by a host computer 300. For the communications interface 110, a wired or wireless interface, such as a USB (Universal Serial Bus), IEEE 1394, or the like, can be used. The image data acquired by the image forming apparatus 10 via this communications interface 110 is stored temporarily in a first memory 114.

The system controller 112 is constituted by a microcomputer and peripheral circuits thereof, and the like, and it forms a main control device which controls the whole of the image forming apparatus 10 in accordance with a prescribed program. More specifically, the system controller 112 controls the respective units of the communications interface 110, the transfer drive unit 120, the conveyance drive unit 122, the print controller 150, and the like.

The transfer drive unit 120 causes the transfer drum 20 to rotate in accordance with instructions from the system controller 112. More specifically, it includes a motor and driver circuits which cause the transfer drum 20 to rotate.

The conveyance drive unit 122 drives the conveyance unit 22 in accordance with instructions from the system controller 112. More specifically, it includes a motor and driver circuits which drive the conveyance rollers 31 and 32, which form the conveyance unit 22.

The liquid supply unit 142 is constituted by a channel and a pump, and the like, which causes ink to flow from an ink tank (not shown) forming an ink storage device for storing ink, to the liquid droplet ejection unit 12.

The liquid supply control unit 144 controls the supply of ink to the liquid droplet ejection unit 12, by means of the liquid supply unit 142.

The print controller 150 is constituted by a microcomputer and peripheral circuits thereof, and the like, and it controls the various sections, such as the transfer state determination unit 42, the liquid supply control unit 144, the head driver 154, and the like, in accordance with a prescribed program.

On the basis of the image data input to the image forming apparatus 10 (the input image data), the print controller 150 generates image data (dot data) required in order to form a transfer image on the transfer surface 20A by ejecting liquid droplets toward the transfer surface 20A of the transfer drum 20 from the liquid droplet ejection heads 50K, 50C, 50M and SOY.

More specifically, the print controller 150 is a control unit which functions as an image processing device that carries out image processing in accordance with the control implemented by the system controller 112, in order to generate dot data for droplet ejection, from the image data inside the first memory 114, and it supplies the dot data thus generated to the head driver 154.

The head driver 154 supplies drive signals to the liquid droplet ejection heads 50 (more specifically, to the actuators corresponding to the respective pressure chambers 52), in accordance with the dot data supplied by the print controller 150.

Furthermore, the print controller 150 judges errors in the transfer surface 20A of the transfer drum 20 on the basis of the state of the transfer surface 20A as determined by the transfer state determination unit 42, and it corrects the image data relating to the next image to be formed on the transfer surface 20A, on the basis of this judgment result.

Next, a more detailed description of the transfer surface 20A error determination processing carried out in the print controller 150 is described below.

Error determination processing of this kind may either be performed in synchronism with the droplet ejection or asynchronously with the droplet ejection.

Figure 6:
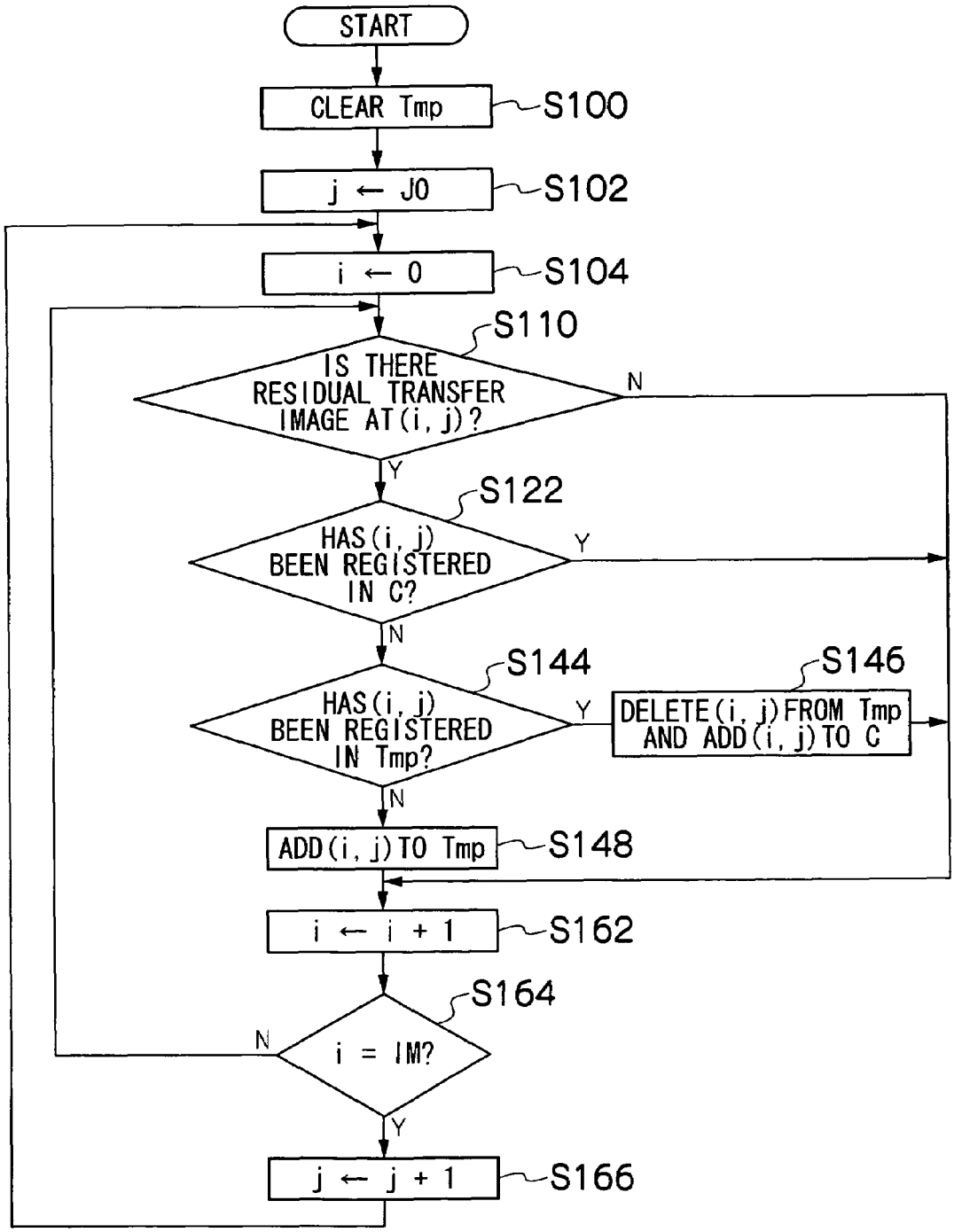
FIG. 6 is a flowchart showing one example of error determination processing which is not synchronized with droplet ejection.

Firstly, one example of a mode where it is asynchronous with the droplet ejection is described with respect to the flowchart in FIG. 6.

Each of the steps shown in FIG. 6 is carried out in accordance with a prescribed program by means of the print controller 150, in the image forming apparatus 10 shown in FIG. 5.

Before starting a printing process for a plurality of sheets of recording paper 16, for example, when the power supply of the image forming apparatus 10 is switched on, the temporary transfer error position data Tmp which includes the data of the temporary transfer error positions on the transfer surface 20A, is cleared (S100). In other words, it is reset to a state where no temporary transfer error positions on the transfer surface 20A are registered. Furthermore, the continuing transfer error position data C which includes the data of continuing transfer error positions, which are described hereinafter, is cleared when the image forming apparatus 10 is introduced, or after maintenance, whereupon the registered contents are maintained inside the image forming apparatus 10.

When a printing process has started, the index j which indicates the pixel under consideration in the sub-scanning direction on the transfer surface 20A, is set to J0, and the index i which indicates the pixel under consideration in the main scanning direction, is set to 0 (S102 and S104). Here, J0 is the position at which the image is transferred onto the front end of the first sheet of recording medium (in other words, the transfer start position).

In the present embodiment, the respective positions on the transfer surface 20A (each of the blocks 202 shown in FIG. 3) are investigated after the transfer, and the presence or absence of a temporary transfer error or a continuing transfer error is judged for each position (block) under consideration.

Firstly, it is determined whether there is residual transfer image at the position under consideration (i, j) or not by means of the transfer state determination unit 42 (S110).

Here, if there is no residual transfer image, then the indices i and j are updated, and the position for consideration (i, j) is moved to the next position (S162, S164, S166, S104). On the other hand, if residual transfer image is determined by the transfer state determination unit 42, then it is judged whether or not the position under consideration (i, j) has already been registered in the continuing transfer error position data C (S122).

Here, if the position under consideration (i, j) is already registered in the continuing transfer error position data C, then the indices i and j are updated, and the position under consideration (i, j) is moved to the next position (S162, S164, S166 and S104). On the other hand, if the position under consideration (i, j) is not registered in the continuing transfer error position data C, then it is judged whether or not the position under consideration (i, j) has already been registered in the temporary transfer error position data Tmp (S144).

Here, if the position under consideration (i, j) has been registered in the temporary transfer error position data Tmp, then since residual transfer image has been determined at this position under consideration (i, j) two times consecutively, the position under consideration (i, j) is recognized to be a "transfer error region". In other words, the position under consideration (i, j) is removed from the temporary transfer error position data Tmp and it is added to the register in the continuing transfer error position data C (S146). Thereupon, the indices i and j are updated, and the position for consideration (i, j) is moved to the next position (S162, S164, S166, S104). If, on the other hand, the position under consideration (i, j) is not registered in the temporary transfer error position data Tmp, then the position under consideration (i, j) is added to the register in the temporary transfer error position data Tmp (S148), and the indices i and j are then updated and the position under consideration (i, j) is moved to the next position (S162, S164, S166 and S104).

In the calculation performed in S166, if j has satisfied "j=JM", then it is set to "j=0".

By means of the error determination processing described above, the residual transfer images are classified as cases where the residual transfer image is temporary (spontaneous) and cases where the residual transfer image is continuing (permanent). Furthermore, if dust is adhering to the transfer surface 20A, then this dust is recognized as residual transfer image; however, in general, dust of this kind is removed by the cleaning unit 44. Therefore, even if such dust is recognized as a temporary transfer error, it will not be recognized mistakenly as a continuing transfer error, in other words, the "transfer error region".

In the flowchart in FIG. 6, the end of the error determination processing is not defined, but the sequence of error determination processing is repeated until the end of the print processing for forming images on the plurality of sheets of recording paper 16.

Next, one example of a mode where error judgment is synchronous with the droplet ejection is described below with respect to the flowchart in FIG. 7.

Figure 7:
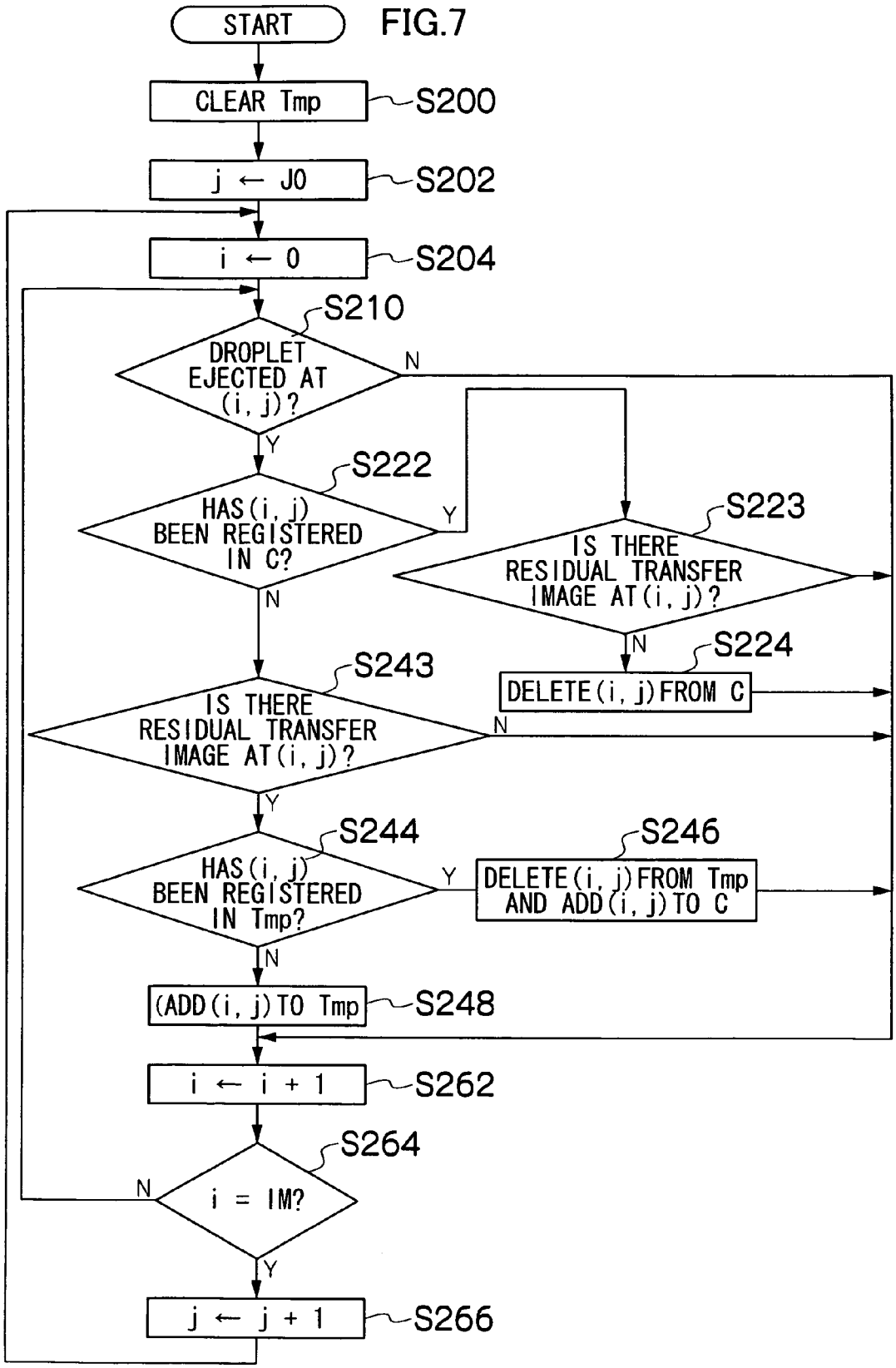
FIG. 7 is a flowchart showing one example of error determination processing which is synchronized with droplet ejection.

Each of the steps shown in FIG. 7 is carried out in accordance with a prescribed program by means of the print controller 150, in the image forming apparatus 10 shown in FIG. 5.

Firstly, before starting the print process for the plurality of sheets of recording paper 16, the temporary transfer error position data Tmp is cleared (S200). Furthermore, the continuing transfer error position data C is cleared when the image forming apparatus 10 is introduced, or after maintenance, whereupon the registered contents are maintained inside the image forming apparatus 10.

When a printing process has started, the index j which indicates the pixel under consideration in the sub-scanning direction on the transfer surface 20A, is set to J0, and the index i which indicates the pixel under consideration in the main scanning direction, is set to 0 (S202 and S204). Here, J0 is the position at which the image is transferred onto the front end of the first sheet of recording medium (in other words, the transfer start position).

In this mode, in order to achieve synchronism with the droplet ejection, it is judged whether or not droplets are ejected within the position under consideration (i, j) on the transfer surface 20A (S210). If even a single ink droplet is ejected to form one dot at any point within the block 202 shown in FIG. 3, which is the position under consideration (i, j), then it is judged at S210 that "droplet ejection has been performed".

Here, if droplet ejection is not performed within the position under consideration (i, j), then the indices i, j are updated, and the position under consideration (i, j) is moved to the next position (S262, S264 S266 and S204). On the other hand, if droplet ejection is performed inside the position under consideration (i, j), then it is judged whether or not the position under consideration (i, j) has already been registered in the continuing transfer error position data C (S222).

Here, if the position under consideration (i, j) has been registered in the continuing transfer error position data C, then it is also judged whether or not there is residual transfer image at the position under consideration (i, j) (S223). If there is no residual transfer image at the position under consideration (i, j), then it is judged that the position under consideration (i, j) on the transfer surface 20A has been restored by an action of some kind, and the position under consideration (i, j) is removed from the continuing transfer error position data C (S224). Thereupon, the indices i and j are updated, and the position for consideration (i, j) is moved to the next position (S262, S264, S266, S204).

At step S222, if the position under consideration (i, j) has not been registered in the continuing transfer error position data C, then it is also judged whether or not there is residual transfer image at the position under consideration (i, j) (S243). If there is no residual transfer image at the position under consideration (i, j), then the indices i and j are updated, and the position under consideration (i, j) is moved to the next position (S262, S264, S266 and S204). If there is residual transfer image at the position under consideration (i, j), then it is judged whether or not the position under consideration (i, j) has already been registered in the temporary transfer error position data Tmp (S244).

Here, if it has been registered in the temporary transfer error position data Tmp, then the position under consideration (i, j) is recognized to be a "transfer error region", and it is removed from the temporary transfer error position data Tmp and added to the register of the continuing transfer error position data C (S246). If, on the other hand, the position under consideration (i, j) is not registered in the temporary transfer error position data Tmp, then the position under consideration (i, j) is added to the register in the temporary transfer error position data Tmp (S248), and the indices i and j are then updated and the position under consideration (i, j) is moved to the next position (S262, S264, S266 and S204).

In the calculation performed in S266, if j has satisfied "j=JM", then it is set to "j=0".

If a scratch 212 such as that shown in FIGS. 4A and 4B has formed on the transfer surface 20A of the transfer drum 20, for example, then the ink ejected onto this degraded portion will not be transferred to the recording paper 16, but rather, it will remain on the transfer surface 20A as residual transfer image. As a result of this, in general, regions of visibly lower density can occur in the recorded image on the recording paper 16. In the image forming apparatus 10 according to the present embodiment, a transfer error region where there is residual transfer image on the transfer surface 20A is recognized as described above, and the image data is corrected in such a manner that the volume of ink ejected in the vicinity of the transfer error region is increased. Accordingly, the visibility of the image fault caused by the transfer error is diminished and hence the quality of the image on the recording paper 16, as seen by a human observer, is maintained.

The image data input from an external source to the image forming apparatus 10 (input image data) is converted in format during the image processing in the image forming apparatus 10, and hence there are different modes for correcting the image data (image correction modes), depending on the stage at which the correction is applied to the image data during the image processing. Two representative image correction modes are described below.

Figure 8:
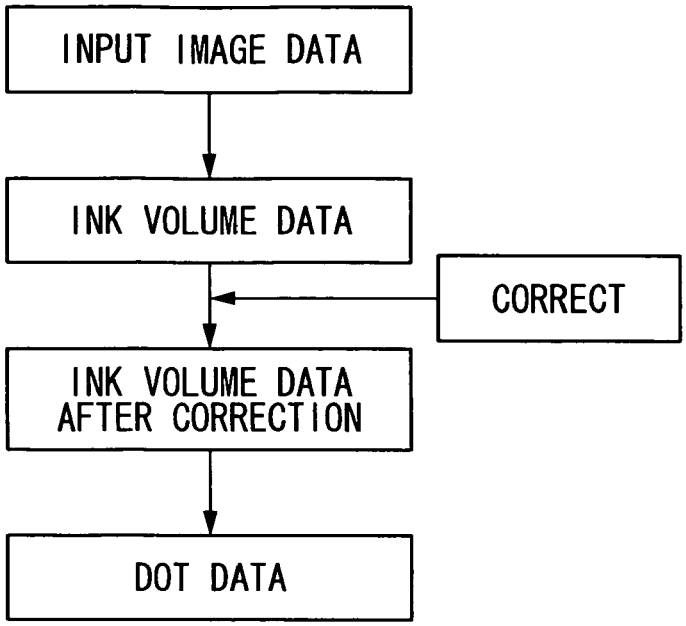
FIG. 8 is a transition chart of image data in a first embodiment of image correction processing.

FIG. 8 shows an overview of the flow of image data in a first image correction mode.

The input image data input from an external source to the image forming apparatus 10 (for example, input image data for respective colors of R, G and B) is converted into image data indicating the ink volumes of the respective colors of Y, M, C and K (hereinafter, also called "ink volume data"). This ink volume data is also called "density data". In the first image correction mode, correction is performed with respect to this ink volume data.

Figure 9:
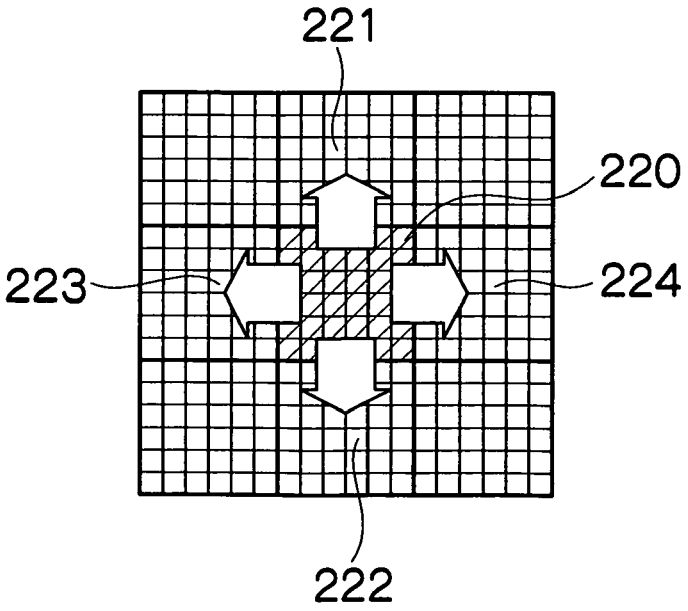
FIG. 9 is an illustrative diagram for describing the first embodiment of the image correction processing.

More specifically, as shown in FIG. 9, the total volume of ink that is to be ejected onto the region of the transfer surface 20A judged to be suffering a transfer error (the transfer error region) 220 is divided and allocated to the regions 221, 222, 223 and 224 that are peripheral to that transfer error region 220.

The numerals 220 to 224 in FIG. 9 represent determination pixels on the transfer surface 20A (in other words, the blocks 202 in FIG. 3), and the squares inside each block represent droplet ejection pixels.

More specifically, the ink volume E to be allocated to each of the peripheral regions 221, 222, 223 and 224 of the transfer error unit 220 is calculated as shown in Formula 1 below.

$$E = \frac{255 \times N - \sum_{(x,y)\in S} D(x, y)}{4} \qquad \text{Formula 1}$$

In Formula 1, S represents the range of the transfer error region 220. Furthermore, x and y represent indices which indicate the pixels inside the transfer error region 220. D(x, y) indicates the ink volume for each pixel inside the transfer error region 220, in 256 tonal graduations. N represents the number of pixels inside the transfer error region 220. Furthermore, it is supposed that the total ink volume of the transfer error region 220 is allocated to the four peripheral regions 221, 222, 223 and 224 to the upper, lower, left-hand and right-hand sides of the transfer error region 220.

In the peripheral regions 221 to 224 to which the ink volume of the transfer error region 220 is allocated, the allocated ink volume E is split up and assigned respectively to the pixels inside each peripheral region, as shown in Formula 2.

$$D(x, y) \leftarrow D(x, y) - \frac{E}{N} \qquad \text{Formula 2}$$

Furthermore, in Formula 2, x and y represent indices which indicate the pixels inside the peripheral regions 221 to 224. D(x, y) indicates the ink volume for each pixel inside the peripheral regions 221 to 224, in 256 tonal graduations. N represents the number of pixels in each of the respective peripheral regions 221, 222, 223, and 224.

Desirably, ink droplets are not ejected onto a transfer error region 220 which has been recognized to be suffering a transfer error. In other words, all of the ink volume of the transfer error region 220 is allocated to the peripheral regions, and the ink volume inside the transfer error region 220 is reduced to zero. This is in order to prevent the transfer error region 220 from appearing dark to a human observer, if the transfer error region 220 happens to be restored by an action of some kind. However, as shown in FIG. 7, if it is judged that the transfer error region 220 has been restored, then since the allocation of the ink volume to the peripheral regions is halted when the transfer error region 220 is restored by an action of some kind, ink droplets are subsequently ejected onto the transfer error region 220 that has been recognized to be suffering a transfer error.

The ink volume data that has been corrected in this way is subjected to digital halftoning by an error diffusion method, or the like, thereby converting the data into image data corresponding to the respective dots formed on the transfer surface 20A and the recording paper 16 (hereinafter, also called "dot data"). This dot data is supplied from the print controller 150 to the head driver 154, and drive signals are applied to the liquid droplet ejection heads 50Y, 50M, 50C and 50K from the head driver 154, on the basis of this dot data. Thereby, a transfer image is formed on the transfer surface 20A of the transfer drum 20, and this transfer image is then transferred to the recording paper 16.

Figure 10:
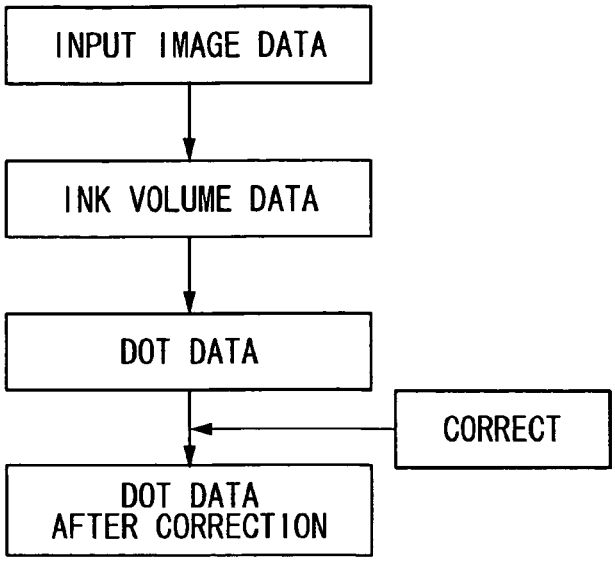
FIG. 10 is a transition chart of image data in a second embodiment of image correction processing.

In the second image correction mode, as shown in FIG. 10, correction is carried out with respect to the dot data.

Figure 11:
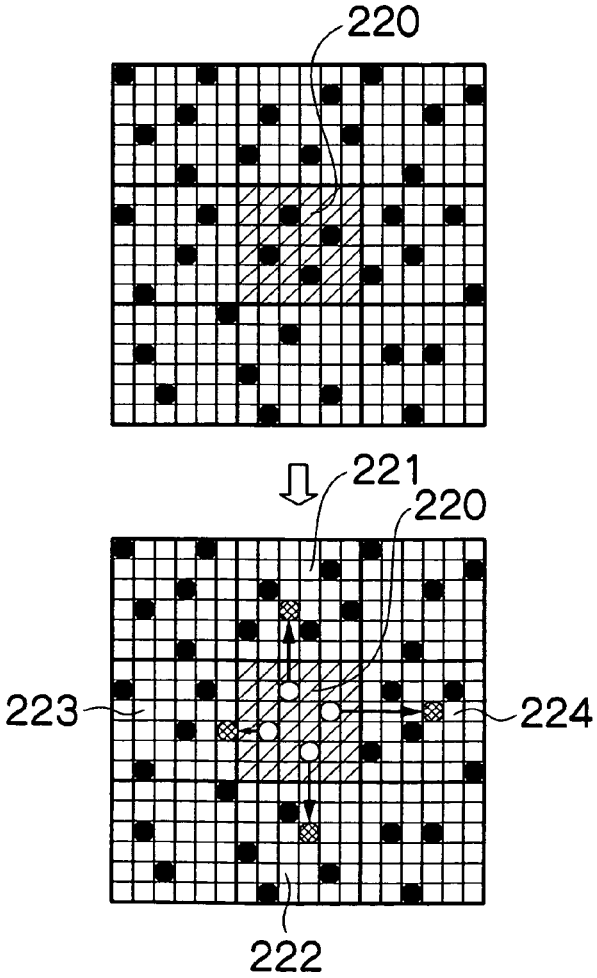
FIG. 11 is an illustrative diagram for describing the second embodiment of the image correction processing.

More specifically, as shown in FIG. 11, the dots inside the transfer error section 220 are allocated to the regions 221, 222, 223 and 224 which are peripheral to the transfer error region 220.

Desirably, the dot data inside the transfer error region 220 is reduced to zero dots, as shown in FIG. 11. This is in order to prevent the transfer error region 220 from appearing dark to a human observer, if the transfer error region 220 happens to be restored by an action of some kind. However, as shown in FIG. 7, if it is judged that the transfer error region 220 has been restored, then since the allocation of the dots to the peripheral regions is halted when the transfer error region 220 is restored by an action of some kind, ink droplets are subsequently ejected onto the transfer error region 220 that has been recognized to be suffering a transfer error.

Figure 12:
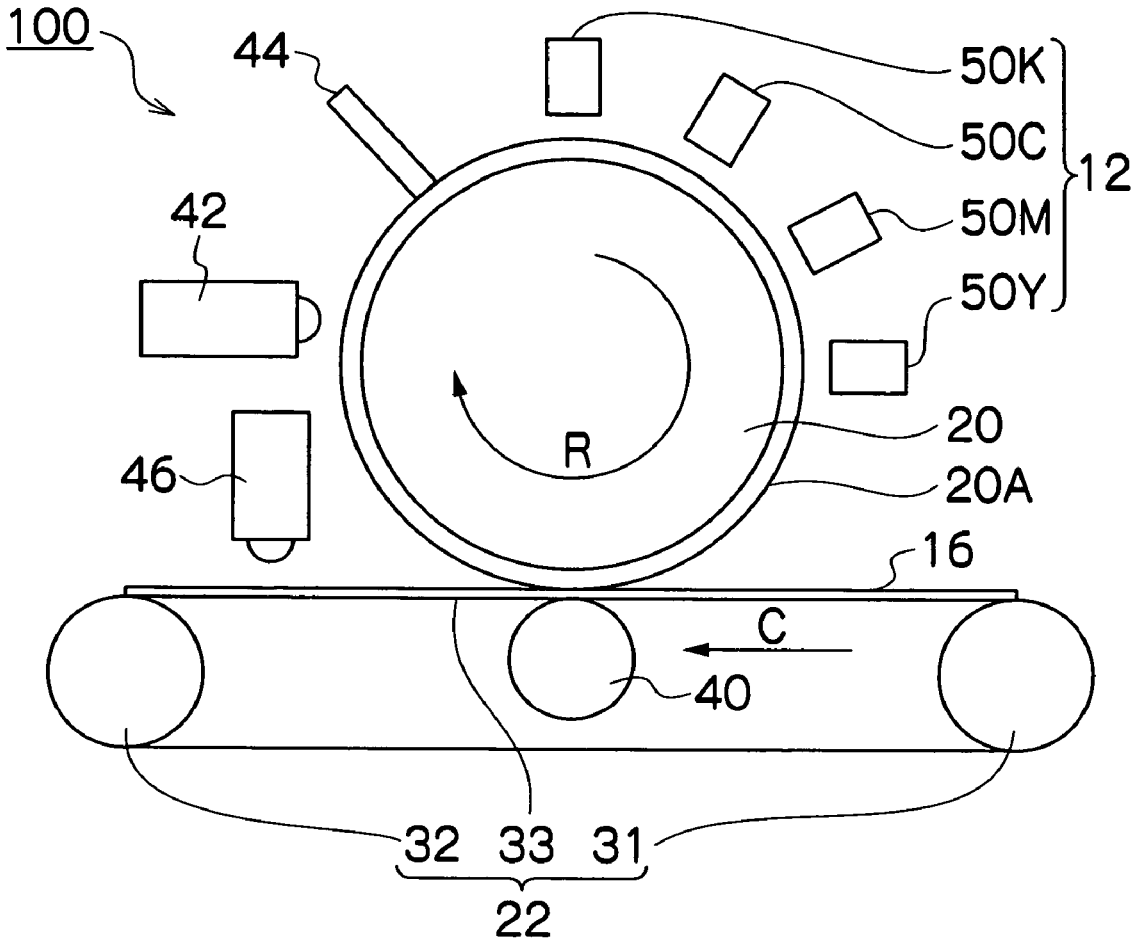
FIG. 12 is a general schematic drawing showing an approximate view of the functional composition of the image forming apparatus according to a second embodiment.

FIG. 12 is a general schematic drawing showing the general composition of an image forming apparatus 100 relating to a second embodiment of the present invention. Furthermore, FIG. 13 is a block diagram showing the approximate functional composition of the image forming apparatus 100 illustrated in FIG. 12.

Figure 13:
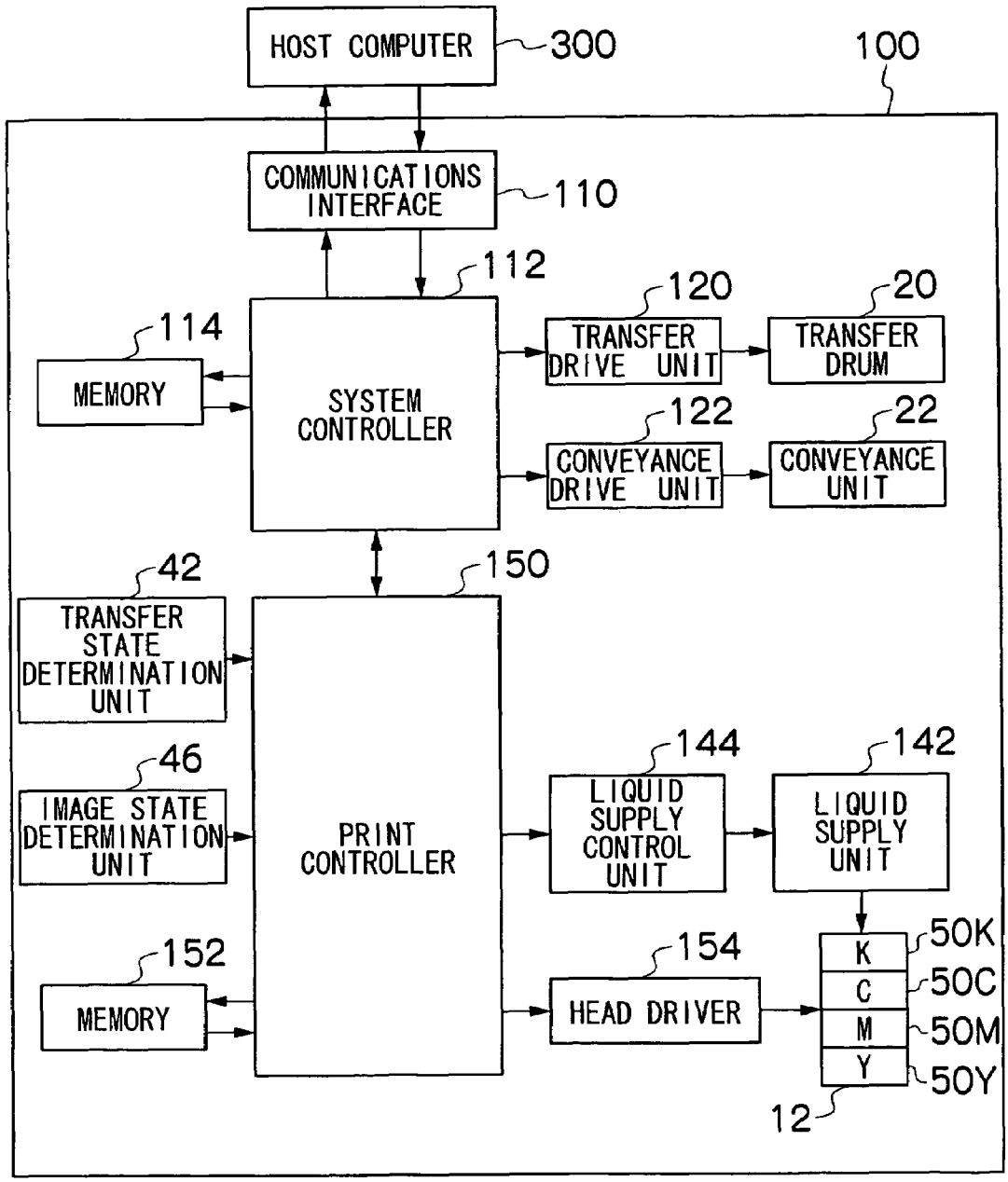
FIG. 13 is a block diagram showing an approximate view of the functional composition of the image forming apparatus according to the second embodiment.

In FIG. 12 and FIG. 13, constituent elements which are the same as the constituent elements of the image forming apparatus 10 according to the first embodiment shown in FIG. 1 and FIG. 5 are labeled with the same reference numerals.

In FIG. 12 and FIG. 13, the image forming apparatus 100 according to the second embodiment further comprises an image state determination unit 46 which determines the state of the image transferred onto the recording paper 16.

In the image forming apparatus 10 according to the first embodiment described above, only the state of the transfer surface 20A of the transfer drum 20 is determined; however, in the image forming apparatus 100 according to the second embodiment, the state of the image transferred onto the recording paper 16 is also determined, in such a manner that the causes of image errors on the recording paper 16 can be classified into transfer errors and ejection errors.

The image state determination unit 46 is constituted by a line sensor which captures an image of the recording surface of the recording paper 16 (the surface onto which an image is transferred from the transfer surface 20A of the transfer drum 20). This line sensor comprises a plurality of photosensors (imaging elements) arranged through a length corresponding to the full width of the recording surface of the recording paper 16 (in other words, the maximum width of the recorded image), which corresponds to the full width of the transfer surface 20A of the transfer drum 20. More specifically, photosensors are aligned in a direction that is perpendicular to the direction of conveyance of the recording paper 16.

A line sensor of this kind uses, for example, a plurality of photosensors having color filters of the respective colors of C, M and Y, in other words, photosensors which respectively have sensitivity to the colors of C, M and Y Alternatively, it may also be constituted by a plurality of photosensors respectively having sensitivity to the colors of R, G and B. It is also possible to use photosensors which have sensitivity to density graduations only, and which are not sensitive to color. One specific example of a line sensor is a CCD (Charge Coupled Device).

Furthermore, the print controller 150 according to the second embodiment judges the cause of an image error recorded onto the recording paper 16, on the basis of the determination results provided by the transfer state determination unit 42 and the determination results provided by the image state determination unit 46.

As shown in FIG. 14, there are four possible combinations of the determination result of the transfer state determination unit 42 and the determination result of the image state determination unit 46.

In the first case, in other words, if both the transfer state determination unit 42 and the image state determination unit 46 have determined a satisfactory result (i.e., a no-error result: "OK"), then it is not necessary to correct the image.

In the second case, in other words, if the transfer state determination unit 42 have determined a unsatisfactory result (i.e., an error result: "NG"), whereas the image state determination unit 46 has determined a satisfactory result (i.e., "OK"), then it is judged that although there has been residual transfer image left on the transfer surface, in practice, both the ejection operation and the transfer operation are being carried out in a substantially correct fashion. In this case also, there is no need to correct the image.

In the third case, in other words, if the transfer state determination unit 42 has determined a satisfactory result ("OK"), whereas the image state determination unit 46 has determined an unsatisfactory result ("NG"), it is deduced that there is an ejection error in the nozzles 51.

In the fourth case, in other words, if both the transfer state determination unit 42 and the image state determination unit 46 have determined an unsatisfactory result ("NG"), then in practice, a transfer error has occurred. It is rare for a transfer error and an ejection error to occur simultaneously in the same position, and therefore, it is supposed that both types of error do not occur simultaneously in the same position, in this way.

Here, an explanation is given of the error determination processing carried out by both the transfer state determination unit 42 and the image state determination unit 46, in synchronism with the droplet ejection.

Here, three different situations are described below: a case where both the resolution of the transfer state determination unit 42 and the resolution of the image state determination unit 46 are lower (coarser) than the resolution of the liquid droplet ejection head 50 (the density of the nozzles 51 in the projected nozzle arrangement); a case where only the resolution of the transfer state determination unit 42 is lower (coarser) than the resolution of the liquid droplet ejection head 50; and a case where the resolution of the transfer state determination unit 42 and the resolution of the image state determination unit 46 are both equal to the resolution of the liquid droplet ejection head 50.

Firstly, one example of error determination processing in a case where the resolution of the transfer state determination unit 42 and the resolution of the image data determination unit 46 are lower than the resolution of the liquid droplet ejection head 50 is described below, with reference to the flowchart in FIG. 15.

In the error determination processing according to the present example, in order to simplify understanding of the present invention, it is supposed that the resolution of the transfer state determination unit 42 is equal to the resolution of the image state determination unit 46.

In the present example, a plurality of pixels correspond to one determination position (one block in which transfer errors are determined and one block in which image errors are determined). In other words, a plurality of nozzles 51 correspond to one determination position. Therefore, when a desired droplet ejection is performed, although it is easy to judge whether or not an ejection error has occurred in one determination position, it is complicated to judge which of the plurality of nozzles 51 corresponding to that one determination position has produced an ejection error. A case is described below in which ejection errors are judged by using test dot data (a test pattern), which allow an ejection error in each nozzle 51 to be judged easily.

Here, the test pattern constitutes dot data formed by ejecting droplets over the whole region of the transfer surface 20A, and by ejecting a droplet from only one nozzle 51 onto the one determination position (one block) for which the transfer state and the image state is to be determined. Therefore, the nozzle ejecting droplets at the determination position (i, j) under consideration is indicated by N(i, j).

The temporary transfer error position data Tmp and the continuing transfer error position data C are used as data representing the position of a transfer error. Furthermore, the temporary ejection error nozzle data TmpN and the continuing ejection error nozzle data CN are used as data representing a nozzle suffering an ejection failure.

Figure 15:
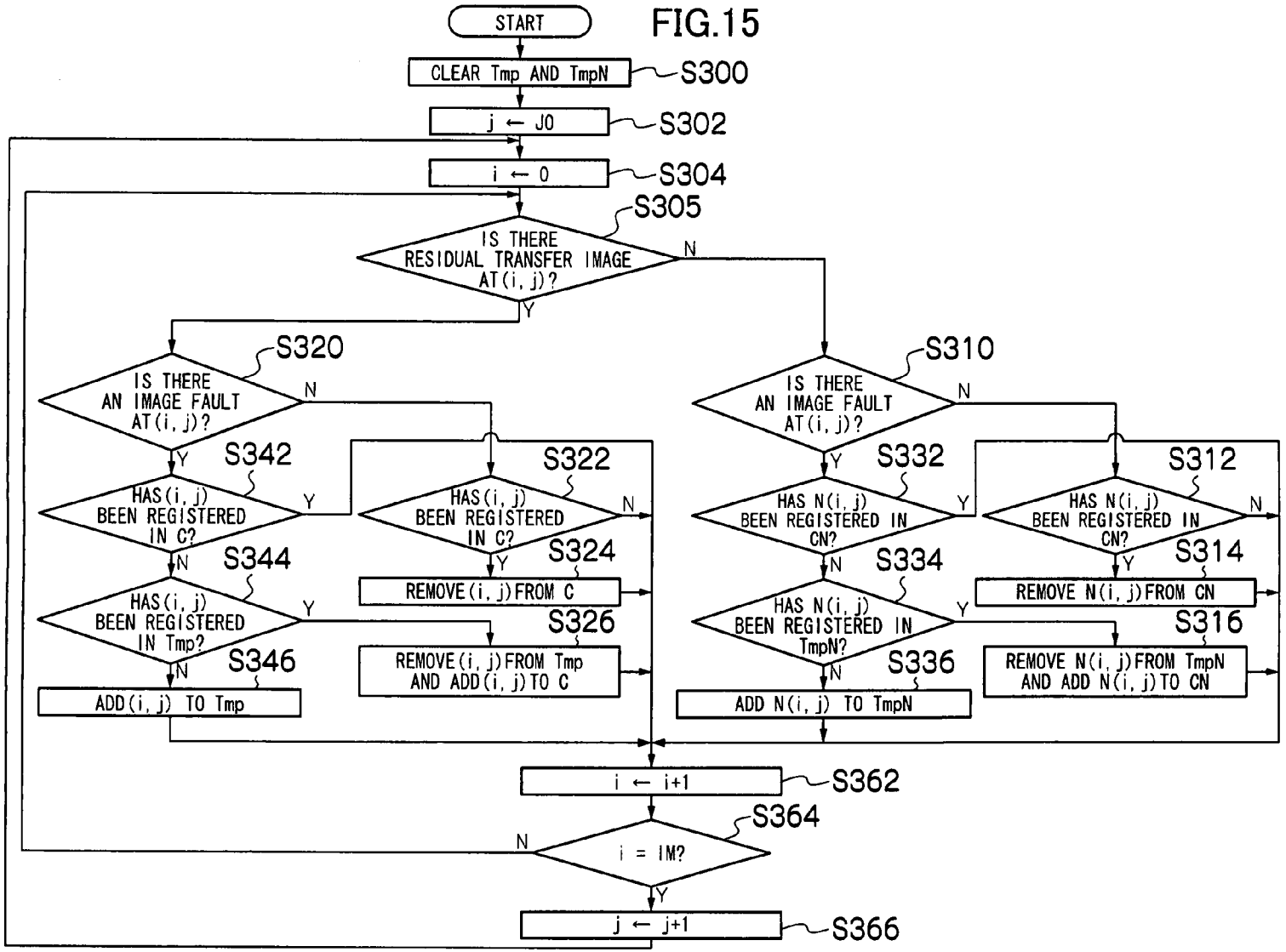
FIG. 15 is a flowchart showing one example of error determination processing in a case where the resolution of the transfer state determination unit and the resolution of the image state determination unit are lower than the resolution of the liquid droplet ejection head.

In FIG. 15, before starting a printing process for a plurality of sheets of recording paper 16, for example, when the power supply of the image forming apparatus 10 is switched on, the temporary transfer error position data Tmp and the temporary ejection error nozzle data TmpN are cleared (S300). Furthermore, the continuing transfer error position data C and the continuing ejection error nozzle data CN are cleared when the image forming apparatus 10 is introduced, or after maintenance, whereupon the registered contents are maintained inside the image forming apparatus 10.

When a printing process has started, the index j which indicates the pixel under consideration in the sub-scanning direction on the transfer surface 20A, is set to J0, and the index i which indicates the pixel under consideration in the main scanning direction, is set to 0 (S302 and S304). Here, J0 is the position at which the image is transferred onto the front end of the first sheet of recording medium (in other words, the transfer start position).

In the present embodiment, the respective positions on the transfer surface 20A (each of the blocks 202 in FIG. 3) are investigated after the transfer, and the presence or absence of a temporary transfer error and the presence or absence of a continuing transfer error are judged for each position (block) under consideration. Furthermore, the positions on the recording paper 16 corresponding to the positions (blocks) on the transfer surface 20A are considered individually, and the presence or absence of a temporary ejection error and the presence or absence of a continuing ejection error at the nozzle 51 are judged.

Firstly, the transfer state determination unit 42 determines whether or not there is residual transfer image at the position under consideration (i, j) (S305), and the image state determination unit 46 determines whether or not there is an image fault at the position on the recording paper 16 corresponding to the position under consideration (i, j) (S310 and S320).

In a first case, in other words, if no residual transfer image is determined at step S305 and no image fault is determined at step S310, then the indices i and j are updated and the position under consideration (i, j) is thus moved to the next position (S362 to S366, S304). Here, before moving the position under consideration, it is judged whether or not the nozzle under consideration N(i, j) which ejects droplets at the position under consideration (i, j) has already been registered in the continuing ejection error nozzle data CN (S312), and if it has already been registered, then the nozzle under consideration N(i, j) is removed from the continuing ejection error nozzle data CN (S314).

In a second case, in other words, if residual transfer image is determined at step S305 but no image fault is determined at step S320, then this means that the position under consideration (i, j) on the transfer surface 20A has been restored by an action of some kind, or that there is a defect, such as a scratch, at the position under consideration (i, j) on the transfer surface 20A but this does not actually give rise to a transfer error. In cases of this kind, since there is no image fault, the indices i and j are updated and the position under consideration (i, j) is moved to the next position (S362 to S366 and S304). Here, before moving the position under consideration, it is judged whether or not the position under consideration (i, j) has already been registered in the continuing transfer error position data C (S322), and if it has already been registered, then the position under consideration (i, j) is removed from the continuing transfer error position data C (S324).

In a third case, in other words, if no residual transfer image is determined at step S305 and if an image fault is determined at step S310, then firstly, it is judged whether or not the nozzle under consideration N(i, j) which ejects droplets at the position under consideration (i, j) has already been registered in the continuing ejection error nozzle data CN (S332).

Here, if the nozzle under consideration N(i, j) is registered in the continuing ejection error position data CN, then no further action is taken, and the indices i and j are updated, thus moving the position under consideration (i, j) to the next position (S362 to S366 and S304).

If the nozzle under consideration N(i, j) has not been registered in the continuing ejection error nozzle data CN, then it is judged whether or not the nozzle under consideration N(i, j) has been registered in the temporary ejection error nozzle data TmpN (S334). If it has been registered, then since the nozzle under consideration N(i, j) has produced an ejection error two times consecutively, it is recognized to be an "ejection error region", and the nozzle under consideration N(i, j) is removed from the temporary ejection error nozzle data TmpN and is newly registered in the continuing ejection error nozzle data CN (S316). On the other hand, if the nozzle under consideration N(i, j) is not registered in the temporary ejection error nozzle data TmpN, then the nozzle under consideration N(i, j) is newly registered in the temporary ejection error nozzle data TmpN (S336). Thereupon, the indices i and j are updated, and the position for consideration (i, j) is moved to the next position (S362 to S366, S304).

In a fourth case, in other words, if residual transfer image is determined at step S305, and furthermore, an image fault is also determined at step S320, then this corresponds to a state where a transfer error actually arises.

Here, firstly, it is judged whether or not the position under consideration (i, j) has already been registered in the continuing transfer error position data C (S342), and if it has been registered, then no further action is taken, and the indices i and j are updated, thus moving the position under consideration (i, j) to the next position (S362 to S366 and S304). On the other hand, if the position under consideration (i, j) has not been registered in the continuing transfer error position data C, then it is judged whether or not this position under consideration (i, j) has already been registered in the temporary transfer error position data Tmp (S344), and if it has been registered, then residual transfer image has been determined two times consecutively at this position under consideration (i, j), and hence the position under consideration (i, j) is recognized to be a "transfer error region". In this case, the position under consideration (i, j) is removed from the temporary transfer error position data Tmp and it is added to the register of the continuing transfer error position data C (S236). If, on the other hand, the pixel under consideration (i, j) has not been registered in the temporary transfer error data Tmp, then the pixel under consideration (i, j) is added to the register of the temporary transfer error position data Tmp (S346).

Thereupon, the indices i and j are updated, and the position for consideration (i, j) is moved to the next position (S362 to S366, S304).

In the calculation performed in S366, if j has satisfied "j=JM", then it is set to "j=0".

Next, a case is described with reference to the flowchart in FIG. 16 in which only the resolution of the transfer state determination unit 42 is lower than the resolution of the liquid droplet ejection head 50 (the density of the nozzles 51 in the projected nozzle arrangement).

Figure 17:
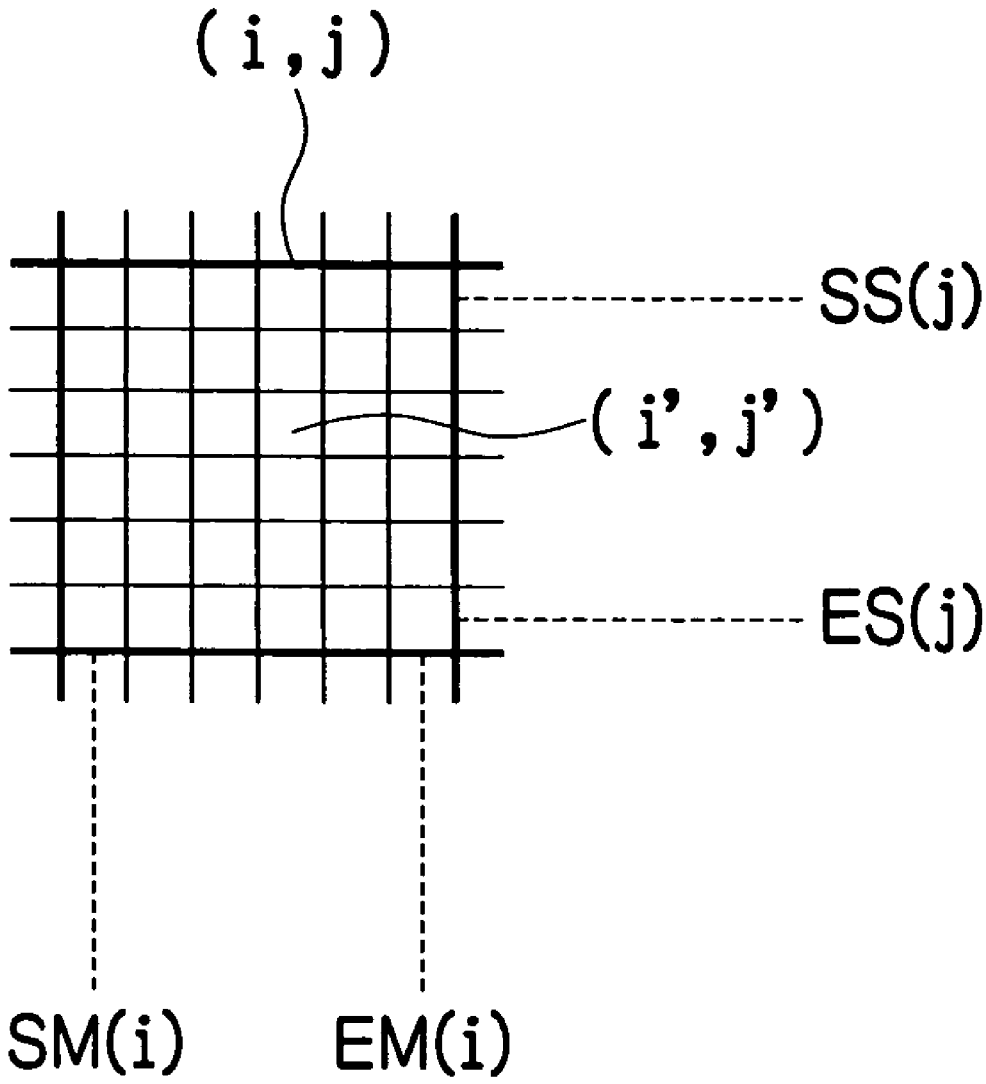
FIG. 17 is an illustrative diagram showing the relationship between the minimum unit of the determination of the transfer state and the minimum unit of the determination of the image state.

(i', j') indicates the position where the image state is under consideration, in the region (i, j) on the recording paper 16 corresponding to the position (i, j) on the transfer surface 20A where the transfer state is under consideration, as shown in FIG. 17. Furthermore, in the image state determination region (i, j), SM(i) represents the start coordinate in the main scanning direction, EM(i) is the end coordinate in the main scanning direction, SS(j) is the start coordinate in the sub-scanning direction and ES(j) is the end coordinate in the sub-scanning direction. Moreover, the nozzle which ejects droplets at the position of coordinate i' in the main scanning direction is represented by N(i').

Figure 16:
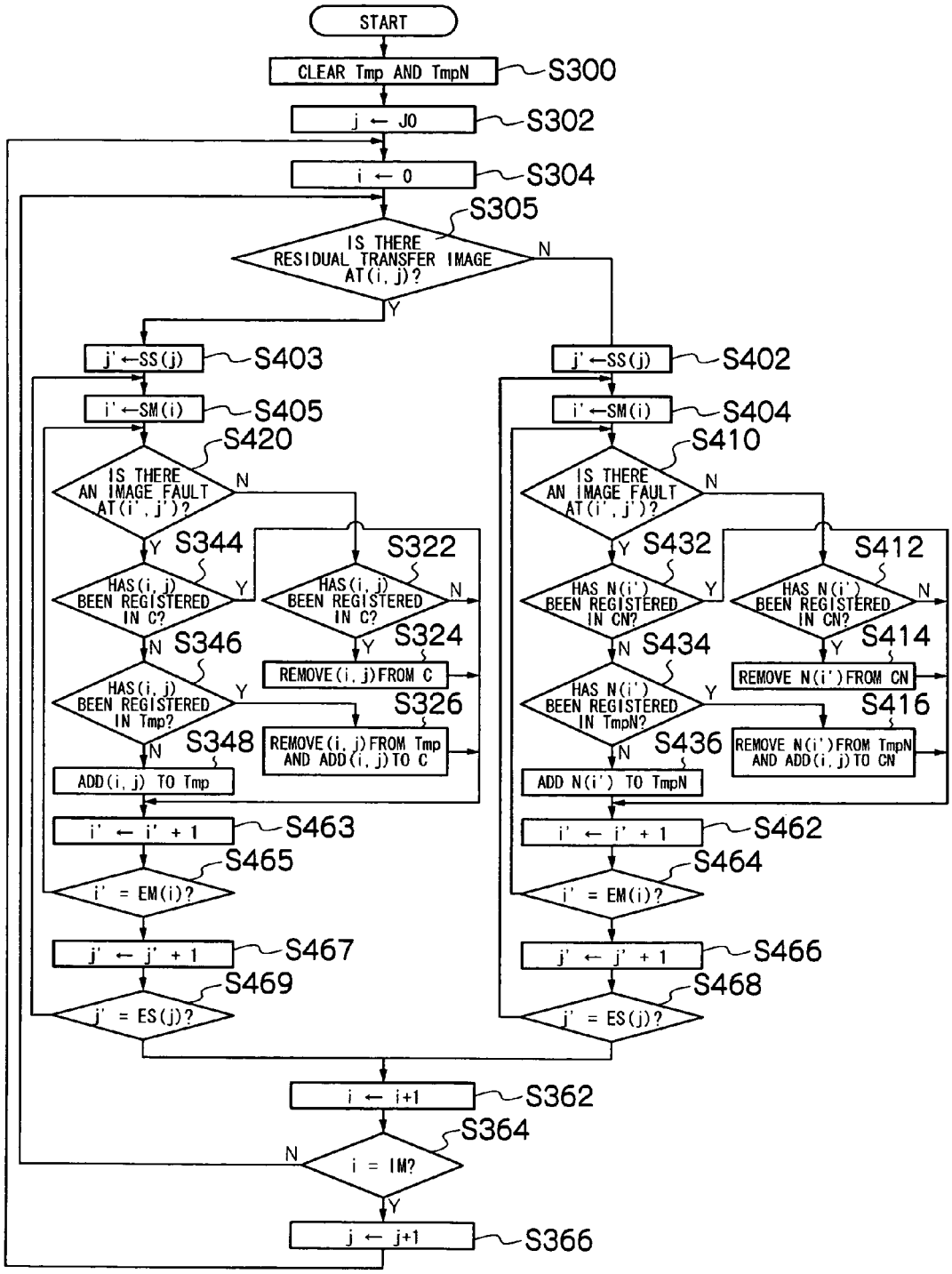
FIG. 16 is a flowchart showing one example of error determination processing in a case where only the resolution of the transfer state determination unit is lower than the resolution of the liquid droplet ejection head.

In FIG. 16, steps which are the same as the error determination processing steps shown in FIG. 15 are labeled with the same reference numerals, and detailed description thereof is omitted here.

In the error determination processing shown in FIG. 16, image faults are judged for each of the positions (i', j') under consideration in relation to the image state, within the region (i, j) on the recording paper 16 corresponding to the position (i, j) under consideration in relation to the transfer state on the transfer surface 20A. In other words, the presence or absence of an image fault is judged at each of the positions under consideration (i', j'), while the indices i' and j' are updated (S402 to S405, S462 to S469) (S410, S420).

The error determination processing shown in FIG. 16 is divided into a first case to a fourth case, according to the combination of the determination result (OK/NG) of the transfer state determination unit 42 and the determination result (OK/NG) of the image state determination unit 46, and the registration and removal of error positions in the data C, Tmp, CN and TmpN is the same as the error determination processing shown in FIG. 15.

Here, in the error determination processing shown in FIG. 16, in contrast to the error determination processing shown in FIG. 15, the presence or absence of an ejection error is judged for each nozzle 51, in accordance with the index i' indicating a nozzle 51 in the projected nozzle arrangement (S412, S414, S416, S432, S434, S436).

Figure 18:
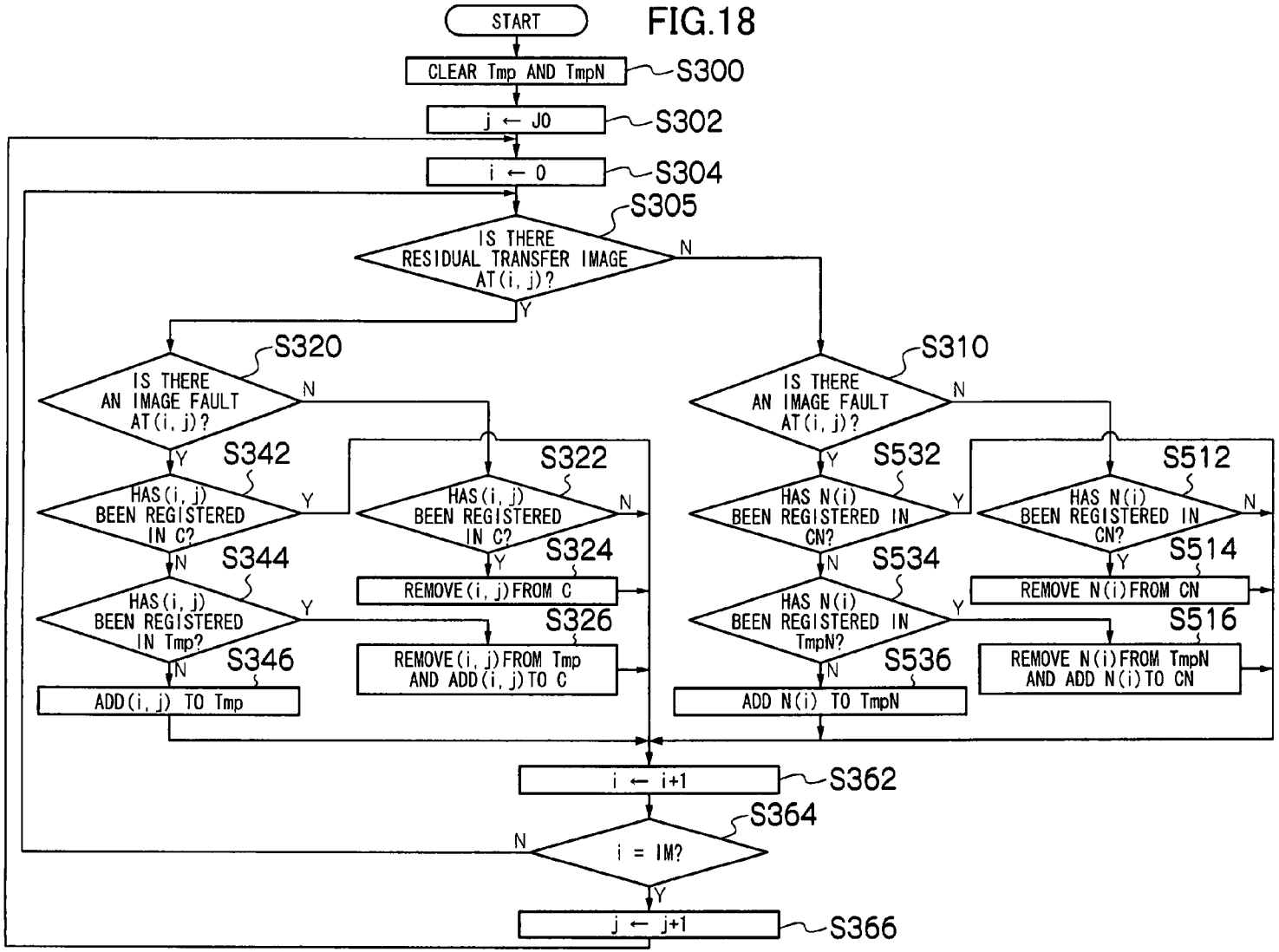
FIG. 18 is a flowchart showing one example of error determination processing in a case where each of the resolution of the transfer state determination unit and the resolution of the image state determination unit is equal to the resolution of the liquid droplet ejection head.

Next, a case where the resolution of the transfer state determination unit 42 and the resolution of the image state determination unit 46 are both equal to the resolution of the liquid droplet ejection head 50 is described below with reference to the flowchart in FIG. 18. In FIG. 18, steps which are the same as the error determination processing steps shown in FIG. 15 are labeled with the same reference numerals, and detailed description thereof is omitted here.

The error determination processing shown in FIG. 18 is divided into a first case to a fourth case, according to the combination of the determination result (OK/NG) of the transfer state determination unit 42 and the determination result (OK/NG) of the image state determination unit 46, and the registration and removal of error positions in the data C, Tmp, CN and TmpN is the same as the error determination processing shown in FIG. 15.

In the error determination processing shown in FIG. 18, in contrast to the error determination processing shown in FIG. 15, the presence or absence of an ejection error is judged for each nozzle 51, in accordance with the index i indicating a nozzle 51 in the projected nozzle arrangement (S512, S514, S516, S532, S534, S536).

After the error determination processing described above is carried out, as explained using FIG. 8 to FIG. 11, the visibility of transfer errors is reduced by correcting the image data, in such a manner that the volume of ink in the droplets ejected in the periphery of the transfer error region (which may include the transfer error region) is made greater than normal.

Furthermore, in the second embodiment, needless to say, not only is the image data corrected with respect to transfer errors, but the image data is also corrected with respect to ejection errors.

The present invention is not limited to the examples described in the embodiments and various design modifications and improvements may be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

an image forming device which includes an intermediate transfer body having a transfer surface on which an image is formed according to a first image data, the image forming device performing a transfer of the image onto a recording medium from the transfer surface;

a transfer state determination device which determines a state of the transfer surface after the transfer of the image onto the recording medium has been performed; and an image correction device which corrects a second image data corresponding to an image formed on the transfer surface and transferred to the recording medium, according to the state of the transfer surface determined by the transfer state determination device.

2. The image forming apparatus as defined in claim 1, further comprising an adhering matter removal device which is provided posterior to the transfer state determination device in terms of a direction of movement of the transfer surface of the intermediate transfer body and removes adhering matter remaining on the transfer surface.

3. The image forming apparatus as defined in claim 2, wherein, the transfer state determination device determines whether a residual transfer image is present or absent on the transfer surface and determines whether the residual transfer image is a continuing residual transfer image or a temporary residual transfer image by determining a plurality of the states of the transfer surface which are respectively shown after a plurality of the transfers; and the image correction device corrects the second image data when the transfer state determination device determines that a continuing residual transfer image is present on the transfer surface.

4. The image forming apparatus as defined in claim 1, wherein the transfer state determination device determines the state of the transfer surface only in a region on the transfer surface in which the image has been formed, according to the first image data.

5. The image forming apparatus as defined in claim 1, further comprising an image state determination device which determines a state of a transferred image on the recording medium which is obtained by the transfer of the image onto the recording medium, wherein the image correction device corrects the second image data, according to the state of the transfer surface determined by the transfer state determination device and the state of the transferred image on the recording medium determined by the image state determination device.

6. The image forming apparatus as defined in claim 3, wherein the image correction device increases image density of peripheral regions around the continuing residual transfer image on the transfer surface.

7. The image forming apparatus as defined in claim 3, wherein the image correction device allocates ink volume for a transfer error region of the transfer surface on which the continuing residual transfer image is present, to peripheral regions around the transfer error region of the transfer surface.

8. The image forming apparatus as defined in claim 7, wherein the image correction device reduces the ink volume for the transfer error region to zero.

9. The image forming apparatus as defined in claim 5, wherein, when the transfer state determination device determines that the state of the transfer surface after the transfer of the image on the recording medium has been performed is poor and the image state determination device determines that the state of the transferred image on the recording medium is good, then the image correction device does not correct the second image data.

* * * * *